US008668314B2

(12) United States Patent
Katoh

(10) Patent No.: US 8,668,314 B2
(45) Date of Patent: Mar. 11, 2014

(54) IMAGE FORMING APPARATUS INCLUDING RECORDING HEAD FOR EJECTING LIQUID DROPLETS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 13/206,687

(22) Filed: Aug. 10, 2011

(65) Prior Publication Data

US 2012/0044284 A1 Feb. 23, 2012

(30) Foreign Application Priority Data

Aug. 18, 2010 (JP) ..... 2010-182709

(51) Int. Cl.
*B41J 29/38* (2006.01)
*B41J 2/17* (2006.01)
*B41J 2/175* (2006.01)

(52) U.S. Cl.
USPC ..... 347/84; 347/6; 347/85

(58) Field of Classification Search
USPC ..... 347/84–87, 6
See application file for complete search history.

(56) References Cited

U.S. PATENT DOCUMENTS 5,992,990 A * 11/1999 Childers et al. ..... 347/87
7,325,908 B2 2/2008 Katoh et al.
2005/0083367 A1* 4/2005 Nakamura ..... 347/22
2008/0273046 A1* 11/2008 Ishinaga et al. ..... 347/6
2009/0219353 A1* 9/2009 Price et al. ..... 347/86
2009/0290002 A1 11/2009 Katoh
2010/0214378 A1 8/2010 Katoh et al.
2011/0050816 A1 3/2011 Katoh et al.
2011/0134184 A1 6/2011 Katoh et al.
2011/0141167 A1 6/2011 Kikkawa et al.

FOREIGN PATENT DOCUMENTS

JP 5-504308 7/1993
JP 3606282 10/2004
JP 2004-351845 12/2004
JP 2005-342960 12/2005
JP 2010-194973 9/2010

* cited by examiner

*Primary Examiner* — Jason Uhlenhake
(74) *Attorney, Agent, or Firm* — Cooper & Dunham LLP

(57) ABSTRACT

An image forming apparatus includes a recording head, a liquid tank, a first passage, a second passage, a pressure unit, and a control valve. The first passage is connected to the head to supply liquid to the head. The second passage is connected to the tank. The pressure unit is disposed at the second passage to apply pressure to liquid in the second passage. The control valve includes an internal channel to connect the first and second passages, an expandable liquid retaining chamber connected to the internal channel to retain the liquid, and a valve member disposed in the internal channel to open and close the first and second passages and movable by a flow of liquid from the chamber to the first passage created by ejection of liquid from the head to communicate the second passage with the first passage.

17 Claims, 14 Drawing Sheets

IMAGE FORMING APPARATUS INCLUDING RECORDING HEAD FOR EJECTING LIQUID DROPLETS

CROSS-REFERENCE TO RELATED APPLICATIONS

The present patent application claims priority pursuant to 35 U.S.C. §119 from Japanese Patent Application No. 2010-182709, filed on Aug. 18, 2010 in the Japan Patent Office, which is hereby incorporated herein by reference in its entirety.

BACKGROUND

1. Technical Field

This disclosure relates to an image forming apparatus, and more specifically to an image forming apparatus including a recording head for ejecting liquid droplets.

2. Description of the Background Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. During image formation, the inkjet recording apparatus ejects droplets of ink or other liquid from the recording head onto a recording medium to form a desired image.

Such liquid-ejection-type image forming apparatuses fall into two main types: a serial-type image forming apparatus that forms an image by ejecting droplets from the recording head while moving the carriage with the recording head in a main scanning direction, and a line-head-type image forming apparatus that forms an image by ejecting droplets from a linear-shaped recording head held stationary in the image forming apparatus as the recording medium is conveyed thereto.

As for the recording heads used in these liquid-ejection-type image forming apparatuses, several different types are known. One example is a piezoelectric recording head that ejects droplets by deforming a diaphragm using, e.g., a piezoelectric actuator. When the piezoelectric actuator deforms the diaphragm, the volume of a chamber located behind the diaphragm and containing the liquid is changed. As a result, the internal pressure of the chamber increases, thus ejecting droplets from the head. Another example is a thermal recording head that ejects droplets by increasing the internal pressure of the chamber using a heater. This increase is accomplished, for example, by using a heater located in the chamber that is heated by an electric current to generate bubbles in the chamber. As a result, the internal pressure of the chamber increases, thus ejecting droplets from the head.

For such liquid-ejection type image forming apparatuses, there is demand for enhancing throughput, i.e., speed of image formation. One way to achieve enhanced throughput is to enhance the efficiency of liquid supply. For example, a tube supply method is proposed in which ink is supplied from a high-capacity ink cartridge (main tank) mounted in the image forming apparatus to a head tank (also referred to as a sub tank or buffer tank) mounted in an upper portion of the recording head through a tube.

In the tube supply method, because ink ejected from the recording head during image formation is supplied from the ink cartridge to the recording head through the tube, for example, use of a flexible narrow tube increases fluid resistance against ink passing through the tube. As a result, ink may not be timely supplied in an adequate amount to the recording head, thus causing ejection failure. In particular, in a case in which a large-size image forming apparatus that records images onto recording media having large widths employs the tube supply method, a relatively long tube is required, thus further increasing the resistance of the tube against ink flow. Moreover, high-speed printing and/or ejection of highly viscous ink may increase the resistance of the tube against ink flow, thus causing shortage of ink supplied to the recording head.

To counteract these problems, a conventional liquid ejection apparatus is proposed that has a differential pressure valve (negative-pressure conjunction valve) disposed upstream from the recording head in the ink supply direction. The liquid ejection apparatus maintains ink in the ink cartridge in a pressurized state, and supplies ink with the differential pressure valve when the negative pressure within the sub tank exceeds a threshold value.

Further, other techniques for dealing with pressure loss due to fluid resistance of the tube include actively controlling the ink supply pressure by using a pump with or without a negative-pressure chamber that maintains an internal negative pressure with a spring disposed upstream from the recording head in the ink supply direction.

Although generally effective for resolving the above-described problem of poor ink replenishment, the controls and mechanisms employed for controlling the pumps that supply the ink and the negative pressure are complex and the negative-pressure conjunction valve needs a superior seal, as with all connecting portions in the ink supply tubes. A reduction in the sealing performance may result in ink leakage from the joints. Further, because the sending amount of ink of the pump need be controlled in accordance with the consumption amount of ink and other factors, complex control, such as feedback control utilizing the pressure in the negative-pressure chamber, may be needed.

Alternatively, in a case in which the above-described conventional techniques are applied to an image forming apparatus that forms images with several different colors of ink, the pump need be separately controlled for each color, thus resulting in complex configuration and upsizing of the apparatus.

BRIEF SUMMARY

In an aspect of this disclosure, there is provided an improved image forming apparatus including a recording head, a liquid tank, a first passage, a second passage, a pressure unit, and a control valve. The recording head has nozzles to eject liquid droplets. The liquid tank is detachably mounted to the image forming apparatus to store liquid to be supplied to the recording head. The first passage is connected to the recording head to supply the liquid to the recording head. The second passage is connected to the liquid tank. The pressure unit is disposed at the second passage to apply pressure to liquid in the second passage. The control valve is disposed between the first passage and the second passage to control supply of the liquid from the second passage to the first passage. The control valve includes an internal channel, an expandable liquid retaining chamber, and a valve member. The internal channel connects the first passage and the second passage. The expandable liquid retaining chamber is connected to the internal channel to retain the liquid. The valve member is disposed in the internal channel to open and close the first passage and the second passage and movable by a flow of liquid from the liquid retaining chamber to the first passage created by ejection of liquid from the recording head to communicate the second passage with the first passage.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
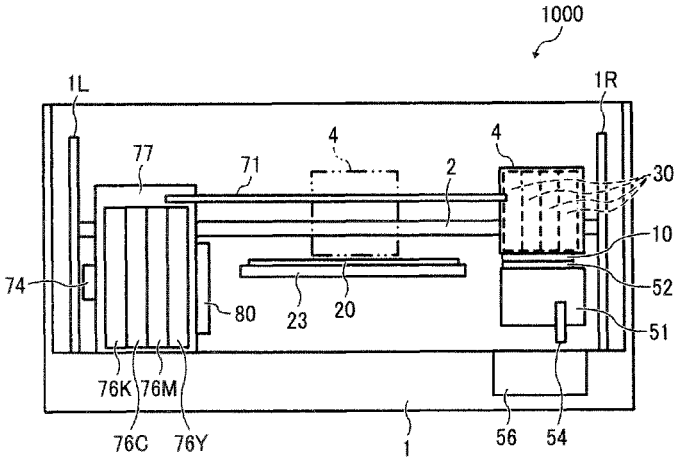
FIG. 1 is a schematic front view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
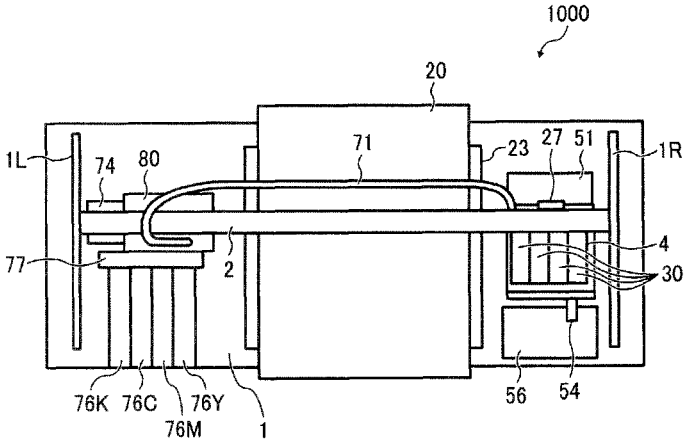
FIG. 2 is a schematic plan view of the inkjet recording apparatus illustrated in FIG. 1.
Figure 3:
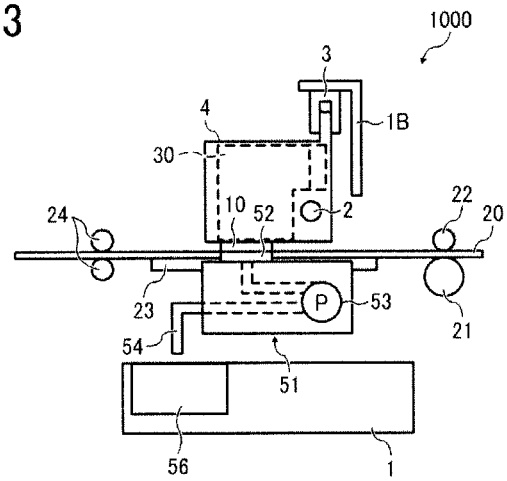
FIG. 3 is a schematic side view of the inkjet recording apparatus illustrated in FIG. 1.

First, an inkjet recording apparatus is described as an image forming apparatus according to an exemplary embodiment of this disclosure with reference to FIGS. 1 to 3.

FIG. 1 is a schematic front view of the inkjet recording apparatus 1000. FIG. 2 is a schematic plan view of the inkjet recording apparatus 1000 of FIG. 1. FIG. 3 is a schematic side view of the inkjet recording apparatus 1000.

In the inkjet recording apparatus 1000, a carriage 4 is supported by a guide rod 2 and a guide rail 3 so as to slide in a main scanning direction (i.e., a long direction of the guide rod 2). The guide rod 2 serving as a guide member is extended between a left-side plate 1L and a right-side plate 1R standing on a main frame 1, and the guide rail 3 is mounted on a rear frame 1B extended on the main frame 1. The carriage 4 is moved in the long direction of the guide rod 2 (the main scanning direction) by a main scanning motor 551 and a timing belt.

On the carriage 4 are mounted at least one recording head 10 for ejecting ink droplets of black (K), cyan (C), magenta (M), and yellow (Y). In this exemplary embodiment, the recording heads 10 are mounted on the carriage 4 so that multiple ink-ejection ports (nozzles) of each recording head are arranged in a direction perpendicular to the main scanning direction and ink droplets are ejected downward from the ejection ports.

Figure 4:
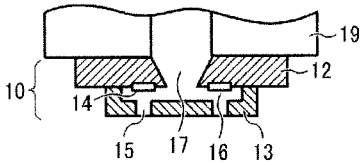
FIG. 4 is an enlarged view of a portion of a recording head of the inkjet recording apparatus illustrated in FIG. 1.

As illustrated in FIG. 4, each of the recording heads 10 includes a heat generator substrate 12 and a chamber formation member 13 and ejects ink sequentially supplied to a common channel 17 and a chamber (separate channel) 16 through an ink supply passage formed in a base member 19. As illustrated in FIG. 4, the recording head 10 may be, for example, a thermal-type head that obtains pressure for ejecting ink by film boiling of ink generated by driving a heating element 14 and a side shooter type in which the direction of ink flow toward an ejection-energy acting area (heating-element area) within the chamber 16 is perpendicular to the central axis of an opening of each nozzle 15.

The recording head is not limited to the thermal type and the side shooter and may be, for example, a piezoelectric-type head that obtains ejection pressure by deforming diaphragms with piezoelectric elements, an electrostatic-type head that obtains ejection pressure by deforming diaphragms with electrostatic force.

Below the carriage 4, a sheet 20 on which an image is formed by the recording heads 10 is conveyed in a direction (hereinafter a "sub-scanning direction") perpendicular to the main scanning direction. As illustrated in FIG. 3, the sheet 20 is sandwiched between a conveyance roller 21 and a pressing roller 22 and conveyed to an image formation area (printing area) at which an image is formed by the recording heads 10. The sheet 20 is further conveyed onto a printing guide member 23 and fed by a pair of output rollers 24 in a sheet output direction.

At this time, the scanning of the carriage 4 in the main scanning direction is properly synchronized with the ejection of ink from the recording heads 10 in accordance with image data to form a first band of a target image on the sheet 20. After the first band of the image has been formed, the sheet 20 is fed by a certain distance in the sub-scanning direction and the recording heads 10 form a second band of the image on the sheet 20. By repeating such operations, the whole image is formed on the sheet 20.

On top of each recording head 10 is integrally connected a head tank (buffer tank or sub tank) 30 including an ink chamber 103 that temporarily stores ink. The term "integrally" as used herein represents that each of the recording heads 10 is connected to the corresponding head tank 30 via, e.g., a tube(s) or pipe(s), and both the recording head 10 and the head tank 30 are mounted on the carriage 4.

Figure 5:
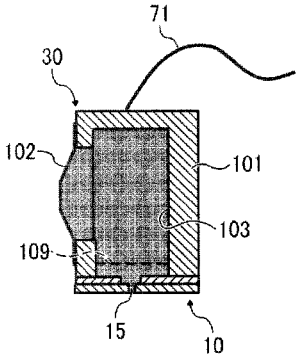
FIG. 5 is a cross-sectional view of a head tank of the inkjet recording apparatus illustrated in FIG. 1.

As illustrated in FIG. 5, the head tank 30 has, for example, a rubber member 102 serving as a flexible, elastic member to cover an opening formed at a portion of a tank case 101 including the ink chamber 103. The rubber member 102 protrudes outward in a convex shape. Within the ink chamber 103, a filter 109 is disposed near a portion connected to the recording head 10 to filter ink. Thus, the head tank 30 removes foreign substances from ink with the filter 109 and supplies ink to the recording head 10.

Desired color inks are supplied from ink cartridges (main tanks) 76 serving as liquid tanks that separately store the respective color inks, to the head tanks 30 via a liquid supply tube 41. The ink cartridges (main tanks) 76 are detachably mounted on a cartridge holder 77 disposed at one end of the inkjet recording apparatus 1000 in the main scanning direction.

Assistive units 80 are disposed between the head tanks 30 and the ink cartridges 76 and connected to the head tanks 30 via liquid supply tubes 71 forming first passages and to the ink cartridges 76 via second passages 70.

At the other end of the inkjet recording apparatus 1000 in the main scanning direction is disposed a maintenance-and-recovery unit 51 that maintains and recovers conditions of the recording heads 10. The maintenance-and-recovery unit 51 includes caps 52 to cover nozzle faces of the recording heads 10 and a suction pump 53 to suction the interior of the caps 52, and a drain passage 54 through which waste liquid (waste ink) suctioned with the suction pump 53 is drained. The waste ink is discharged from the drain passage 54 to a waste tank 56 that is mounted on the main frame 1. The maintenance-and-recovery unit 51 includes a moving mechanism to move the caps 52 back and forth (in this embodiment, up and down) relative to the nozzle faces of the recording heads 10. The maintenance-and-recovery unit 51 further includes a wiping member 57 to wipe the nozzle faces of the recording heads 10 and a wiping unit 58 to hold the wiping member 57 so as to be movable back and forth relative to the nozzle faces of the recording heads 10 (see, for example, FIG. 13).

Next, an example of an ink supply system of the inkjet recording apparatus 1000 is described with reference to FIGS. 6 to 8.

Figure 6:
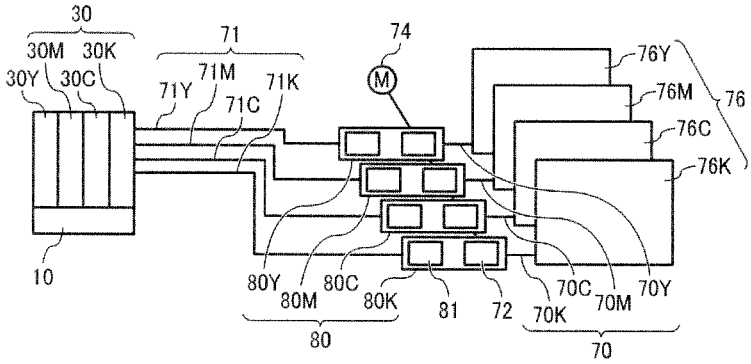
FIG. 6 is a schematic view of an ink supply system according to a first exemplary embodiment of this disclosure.

FIG. 6 is a schematic view of the entire ink supply system. FIG. 7 is a schematic view of an assistive unit of the ink supply system illustrated in FIG. 6. FIG. 8 is a cross-sectional view of a control valve of the assistive unit illustrated in FIG. 7.

In FIG. 6, the ink cartridges 76, the second passages 70, the assistive units 80, the ink supply tubes (first passages) 71, and the head tanks 30 are connected corresponding to four colors of ink.

Each of the assistive units 80 includes a pressure unit 72 serving as a pressure device to apply pressure to ink in the second passage 70 and a control valve 81 to control supply of ink from the second passage 70 to the first passage 71.

The pressure unit 72 applies pressure to ink in the second passage 70 connected to the ink cartridge 76 to send ink to the control valve 81. For example, as illustrated in FIG. 7, the pressure unit 72 circulates ink with an assistive pump 73 in a direction indicated by an arrow A through a circulation passage 78 of, e.g., a loop shape including a passage resistance unit 75. Thus, the pressure unit 72 applies pressure to a branching portion 79 serving as an ink intake portion of the control valve 81. The passage resistance unit 75 includes a structure in which the passage is narrowed, and may be, for example, a duct of a small diameter. The assistive pump 73 may be, for example, a tube pump, a diaphragm pump, a gear pump, or any other suitable pump.

In this exemplary embodiment, four assistive pumps 73K, 73C, 73M, and 73Y corresponding to four ink colors, i.e., black (K), cyan (C), magenta (M), and yellow (Y) are driven with a single motor 74.

Figure 8:
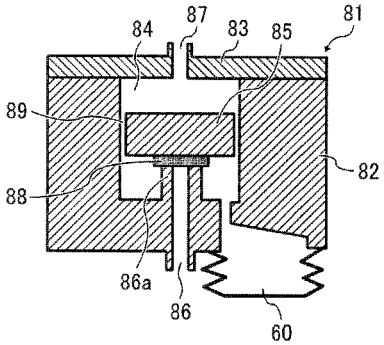
FIG. 8 is a cross-sectional view of a control valve of the assistive unit illustrated in FIG. 7.

For example, as illustrated in FIG. 8, the control valve 81 includes a duct (internal channel) 84 formed inside a case member 82 and a lid member 83 that are bonded together, an inflow port 86 connected to the branching portion 79 of the pressure unit 72 at one side of the duct 84, and an outflow port 87 connected to the liquid supply tube 71 at the opposite end of the duct 84.

A valve member 85 is movably disposed within the duct 84. The valve member 85 is made of a material resistant to corrosion even in ink, for example, stainless steel, and a seal member 88 of, e.g., rubber or elastomer is disposed at a face of the valve member 85 opposing the inflow port 86. When printing is not being performed, the valve member 85 moves under its own weight to cover the inflow port 86.

The control valve 81 includes a buffer chamber 60 serving as a liquid retaining chamber connected to the duct 84. A portion of the buffer chamber 60 is made of a deformable material so that the internal capacity is variable. For example, as illustrated in FIG. 8, the buffer chamber 60 may be formed by bonding an accordion member to the case member 82 to obtain the variable internal capacity.

Next, supply operation of the ink supply system is described with reference to FIGS. 9A to 9D.

Figure 7:
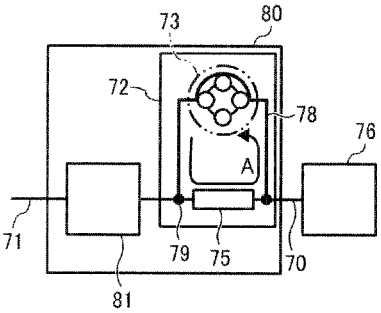
FIG. 7 is a schematic view of an assistive unit of the ink supply system illustrated in FIG. 6.
Figure 9A:
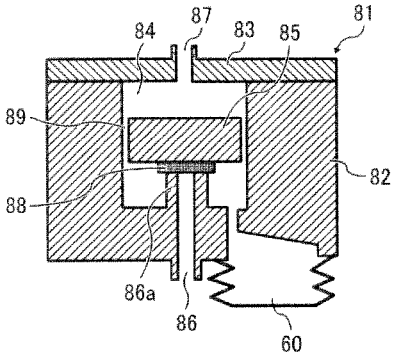
FIGS. 9A to 9D are cross-sectional views of the control valve during supply operation in the ink supply system of FIG. 6.

Before printing (recording), the motor 74 drives the assistive pump 73 to circulate ink in the direction indicated by the arrow A in FIG. 7 to apply pressure to the inflow port 86 of the control valve 81. In this state, as illustrated in FIG. 9A, the duct 84 in the control valve 81 is shut from the inflow port 86 by the action of gravity on the valve member 85. As a result, the outflow port 87 is at a negative pressure as in the recording head 10.

Figure 9B:
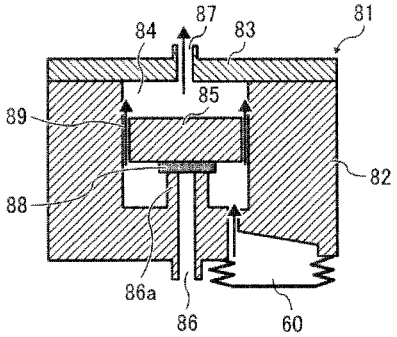

When ink is ejected from the recording head 10, ink is supplied from the head tank 30. At this time, the rubber member 102 of the head tank 30 deforms, thus increasing the negative pressure within the head tank 30. As illustrated in FIG. 9B, such an increase in the negative pressure causes the buffer chamber 60 to contract, thus creating ink flow toward the outflow port 87 through a clearance 89 between the valve member 85 and the duct 84. If the clearance 89 between the outer circumferential surface of the valve member 85 and the inner circumferential surface of the duct 84 is narrow, the flow of ink passing through the clearance 89 creates a difference in pressure between upper and lower areas of the duct 84 relative to the valve member 85 (upstream and downstream areas of the duct 84 from the valve member 85 in a direction in which ink flows through the duct 84). The difference in pressure creates a force for raising the valve member 85 (moving the valve member 85 toward the outflow port 87), thus causing the valve member 85 to move up toward the outflow port 87.

Figure 9C:
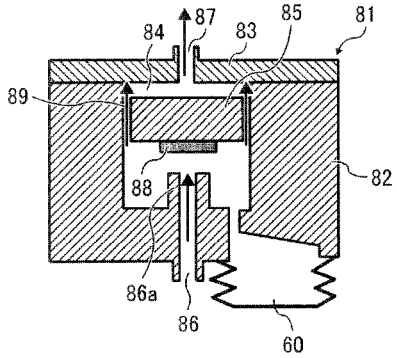

As a result, as illustrated in FIG. 9C, sealing of an intake 86*a* of the inflow port 86 with the valve member 85 is released, thus causing pressurized ink in the inflow port 86 to flow into the duct 84. Thus, ink is supplied to the outflow port 87 at high speed while inflating the buffer chamber 60.

Figure 9D:
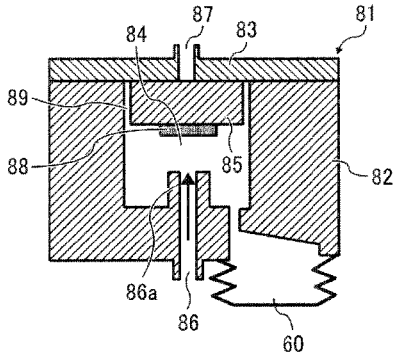

As a result, ink is replenished into the head tank 30, thus reducing the negative pressure within the head tank 30 (to approximately zero). At this time, as illustrated in FIG. 9D, because ink passes through the clearance 89 between the valve member 85 and the duct 84, the valve member 85 receives the force of ink flow to move up to an upper stop point (e.g., upper dead center).

When the valve member 85 reaches the upper stop point, the valve member 85 covers the outflow port 87, thus stopping supply of ink from the control valve 81 to the head tank 30. At this time, the pressure at the outflow port 87 becomes a positive pressure close to the pressure at the inflow port 86. Further, the flow of ink through the clearance 89 serving as a drive source for raising the valve member 85 is lost, and a large difference in pressure created by the ink flow through the narrow clearance 89 is also lost. As a result, the valve member 85 moves down by the action of gravity to close the inflow port 86 as illustrated in FIG. 9A.

When ink ejection from the recording head 10 continues and the negative pressure within the head tank 30 increases, the valve member 85 moves up toward the outflow port 87 while the buffer chamber 60 contracts. As a result, the inflow port 86 is connected to the outflow port 87 via the clearance 89 of the duct 84, and pressurized ink is replenished to the head tank 30.

As described above, ink ejection from the recording head 10 causes ink flow from the buffer chamber 60 in the control valve 81, thus moving the valve member 85. As a result, pressurized ink is automatically supplied toward the recording head 10 at high speed. Accordingly, even in a case in which the ink to be ejected has a high viscosity, the liquid supply tube 71 has a high resistance to fluid flow (the tube 71 is narrow or long), and/or the amount of ink ejection flow is large, the above-described configuration can properly supply ink while preventing delay in ink supply that is otherwise caused by the fluid resistance of the ink supply passage and maintaining the pressure in the recording head within a certain range.

In the ink supply system according to this exemplary embodiment, after the valve member 85 moves up and a certain amount of ink is sent to the head tank 30, the valve member 85 moves down (toward the inflow port 86) to close the inflow port 86. If shortage of the amount of ink supplied to the recording head 10 continues, the valve member 85 repeatedly moves up and down to continuously supply ink to the recording head 10 by the shortage. Accordingly, for example, even if variation occurs in the size of the clearance 89 between the valve member 85 and the duct 84 and/or the pressure amount of ink, the operating frequency or the number of times of operations of the valve member 85 is changed to send a required amount of ink to the recording head 10, thus maintaining the pressure in the recording head within a certain range.

Next, a control unit of the image forming apparatus is described with reference to FIG. 10.

Figure 10:
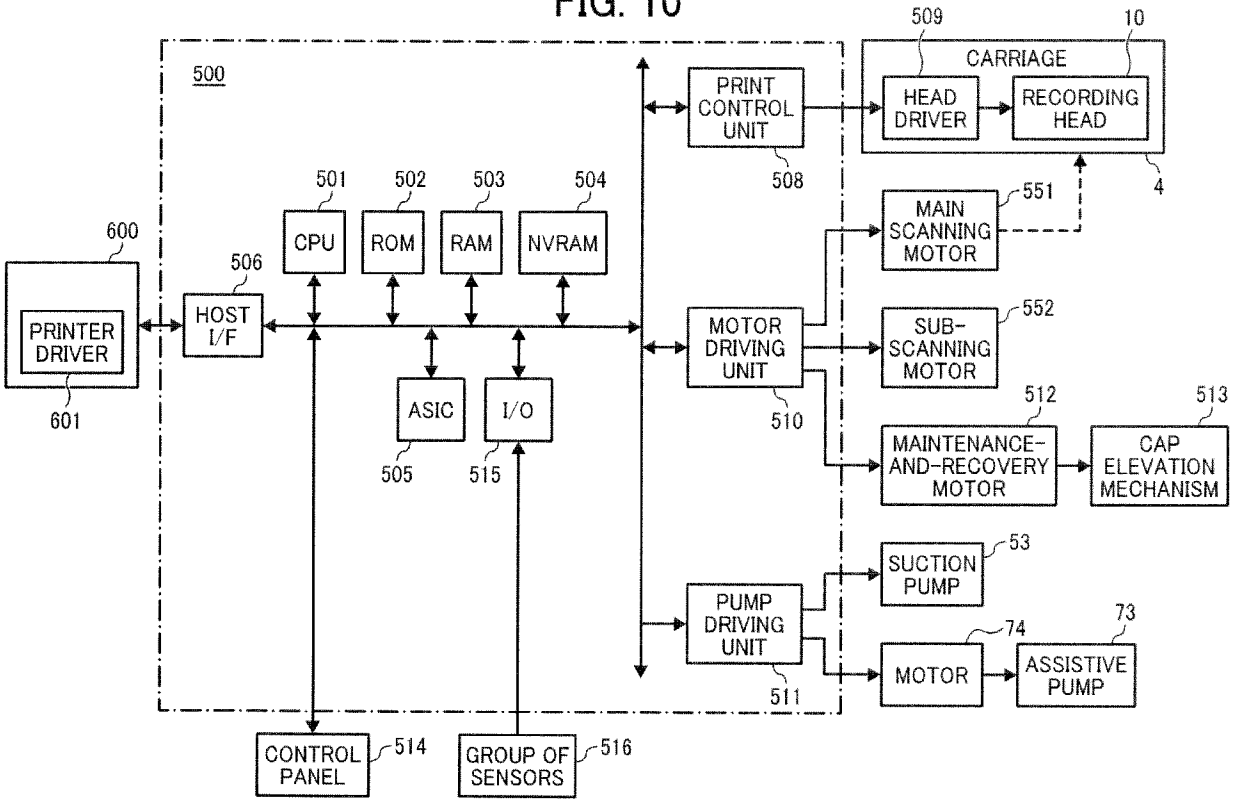
FIG. 10 is a block diagram of a control unit of the image forming apparatus.

FIG. 10 is a block diagram of a control unit 500. The control unit 500 includes a central processing unit (CPU) 501 to control the entire image forming apparatus, program modules including programs controlling the entire image forming apparatus and the motor 74 for driving the assistive pump 73, a read-only memory (ROM) 502 to store other non-erasable data, a random access memory (RAM) 503 to temporarily store image data or other data, a rewritable non-volatile memory 504 to retain data even while the apparatus is powered off, and an application specific integrated circuit (ASIC) 505 to process signals for image data, perform image processing, such as sorting, or process input and output signals for controlling the entire image forming apparatus.

The control unit 500 also includes a print control unit 508 to drive and control the recording heads 10 in accordance with print data, a head driver (driver IC) 509 to drive the recording heads 10 mounted on the carriage 4, a main scanning motor 551 to move the carriage 4 for scanning, a sub-scanning motor 552 to rotate a conveyance roller 21 to convey a sheet 20, a motor driving unit 510 to drive a maintenance-and-recovery motor 512 for activating a cap elevation mechanism 513 to move the caps 52 and the wiping member 57 of the maintenance-and-recovery unit 51 up and down, and a pump driving unit 511 to drive the motor 74 for driving the suction pump 53 of the maintenance-and-recovery unit 51 and the assistive pumps 73.

The control unit 500 is connected to a control panel 514 for inputting and displaying information necessary to the image forming apparatus.

The control unit 500 includes an interface (I/F) 506 for transmitting and receiving data and signals to and from a host 600, such as an information processing device (e.g., personal computer), image reading device (e.g., image scanner), or imaging device (e.g., digital camera) via a cable or network.

The CPU 501 of the control unit 500 reads and analyzes print data stored in a reception buffer of the I/F 506, performs desired image processing, data sorting, or other processing with the ASIC 505, and transmits image data to the head driver (driver IC) 509. A printer driver 601 of the host 600 creates dot-pattern data for image output.

The print control unit 508 transmits the above-described print data as serial data and outputs to head driver (driver IC) 509, for example, transfer clock signals, latch signals, control signals required for the transmission of print data and determination of the transmission. The head driver 509 drives heating elements 14 in accordance with serially-inputted print data corresponding to one band of a desired image recorded by the recording heads 10.

An input/output unit 515 obtains information from a group of sensors 516 installed in the image forming apparatus, extracts information required for controlling printing operation, and controls the print control unit 508 or the motor driving unit 510 based on the extracted information. The group of sensors 516 includes, for example, an optical sensor to detect a position of the sheet, a thermistor to monitor temperature in the apparatus, a sensor to monitor the voltage of a charging belt, and an interlock switch to detect the opening and closing of a cover. The I/O unit 515 is capable of processing information from such various types of sensors. The I/O unit 515 also receives detection signals from, for example, a temperature-and-humidity sensor for detecting environmental conditions (temperature and humidity) and a fill-up detection sensor for detecting whether or not the waste tank 56 is filled up with waste liquid.

Figure 11:
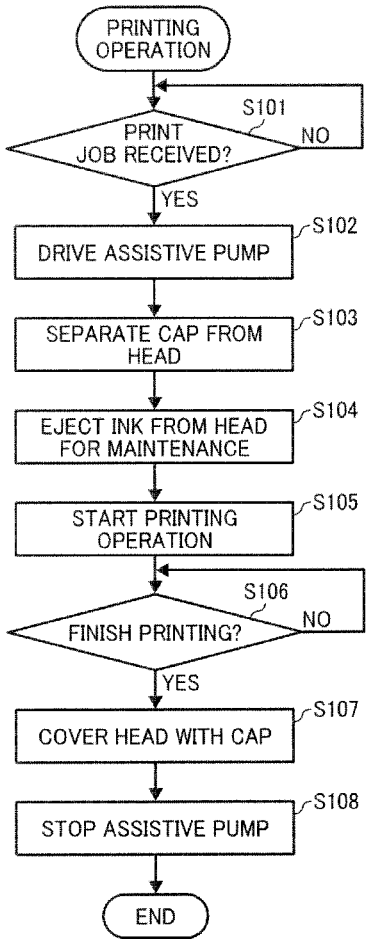
FIG. 11 is a flowchart showing a procedure of printing operation in the first exemplary embodiment.

Next, printing operation according to this exemplary embodiment is described with reference to FIG. 11.

When a print job signal is received (YES at S101), at 5102 the motor 74 is driven to start liquid sending of the assistive pumps 73. At S205, the caps 52 covering the nozzle faces of the recording heads 10 are separated from the nozzle faces, and at S206 a predetermined count of droplets of ink is ejected for maintenance. At S207, printing operation is started.

At this time, because the assistive pumps 73 is driven, even in a case in which the liquid supply tubes 71 are long and highly viscous inks are employed, pressure loss involved with ink supply can be properly minimized. Accordingly, such a configuration performs excellent printing without causing shortage of ink supply.

When printing operation is terminated at S106, the carriage 4 is stopped at a predetermined position (home position) of the inkjet recording apparatus. At S107, the caps 52 cover the nozzle faces of the recording heads 10. At 5210, the motor 74 is stopped to terminate the liquid sending of the assistive pumps 73. Alternatively, the assistive pumps 73 may be stopped immediately after the termination of printing operation.

As described above, the inkjet recording (image forming apparatus) includes the first passages to supply liquid to the recording heads, the second passages connected to the liquid tanks, the pressure units to apply pressure to liquid in the second passages, and the control valves to control supply of liquid from the second passages to the control valves. Each of the control valves includes the expandable liquid retaining chamber and the valve member to open and close the first passage and the second passage. Ejection of liquid from the recording head creates flow of liquid from the liquid retaining chamber to the first passage, thus moving the valve member to communicate the second passage with the first passage. Such a configuration stably maintains negative pressure with a simple structure and supplies liquid without causing shortage of ink to be replenished to the head even when high-speed printing is performed, a long tube is employed, and/or highly viscous liquid is employed.

In the above description, the motor 74 is continuously driven during printing operation, and constant pressure is applied to ink at the inflow port 86 of the control valve 81. Alternatively, the motor 74 may be intermittently driven to apply pulsating pressure to ink at the inflow port 86. Such pulsating pressure creates intermittent rising force (moving force) of the valve member 85. When supply of ink to the head tank 30 is unnecessary, the valve member 85 is securely moved down (to a position to close the inflow port 86), thus allowing more stable ink supply.

The head tank 30 has the rubber member 102. The rubber member 102 expands and contracts in response to pressure and acts as a pressure-fluctuation regulation member. In other words, the rubber member 102 absorbs fluctuation in pressure caused by a difference between the consumption amount of ink and the liquid sending amount of the assistive unit 80, reduces unnecessary pressure pulsation created by the assistive unit 80, and stabilizes the pressure within the recording head 10. To achieve such pressure fluctuation regulation, for example, a configuration in which a wall face made of flexible material, such as a film, is urged with a spring or a configuration in which a certain amount of gas layer is formed can obtain effects equivalent to those of the above-described configuration.

In the above-described image forming apparatus, four color inks are ejected and four ink supply systems are separately provided for the respective four colors. When multiple color inks are ejected for image formation, the amounts of inks ejected from the respective recording heads may be different from each other. For example, one head may eject ink from all nozzles while another head does not eject ink. Even in such a case, in the ink supply system, the control valve 81 automatically operates in response to the ejection flow amount of each recording head 10, thus obviating the control of the assistive pump 73 in accordance with the ejection flow amount of each recording head 10. In other words, the control for giving a small amount of assistance to a head with a small ejection-flow amount not requiring for assistance while giving a large amount of assistance to a head with a large ejection-flow amount requiring for assistance can be automatically performed without electric control. As described above, even in the multiple ink supply systems corresponding to multiple color inks, all the assistive pumps 73 of the ink supply systems are collectively driven with one actuator (the motor 74). Accordingly, the configuration and control of the apparatus are simplified, thus allowing cost reduction and downsizing of the apparatus.

Next, a second exemplary embodiment of the present disclosure is described with reference to FIG. 12.

Figure 12:
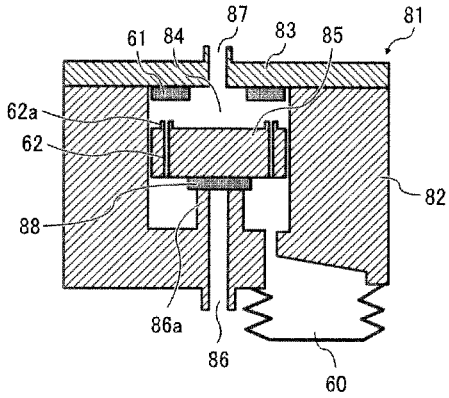
FIG. 12 is a cross-sectional view of a control valve in an ink supply system according to a second exemplary embodiment.

FIG. 12 is a cross-sectional view of a control valve 81 in this exemplary embodiment. In the control valve 81, the clearance between the valve member 85 and the duct 84 is further smaller than that of the first exemplary embodiment. The valve member 85 includes through holes 62, and ink flows from the buffer chamber 60 to the outflow port 87 via the through holes 62 instead of the clearance between the valve member 85 and the duct 84.

For such a configuration, the inner diameter of the through holes 62 is easier to dimensionally control than the clearance 89 between the valve member 85 and the duct 84 as described in the first exemplary embodiment, thus obtaining more stable operation properties of the control valve.

In addition, in FIG. 12, seal members 61 are disposed at the lid member 83 to reliably seal the through holes 62 when the valve member 85 is moved to an upper stop point. Thus, when the valve member 85 reaches the upper stop point, flow of ink through the through holes 62 serving as the source of creating difference in pressure is completely stopped. As a result, the rising force of the valve member 85 decreases and the valve member 85 moves down, thus obtaining enhanced operation stability of the control valve 81. In addition, protrusions 62*a* are formed at outer peripheries of the through holes 62 on a face of the valve member 85 opposing the outflow port 87. Such a configuration reduces an area in which the valve member 85 contacts the seal members 61, thus more reliably sealing the through hole 62.

Next, a third exemplary embodiment of the present disclosure is described with reference to FIGS. 13 to 16.

Figure 13:
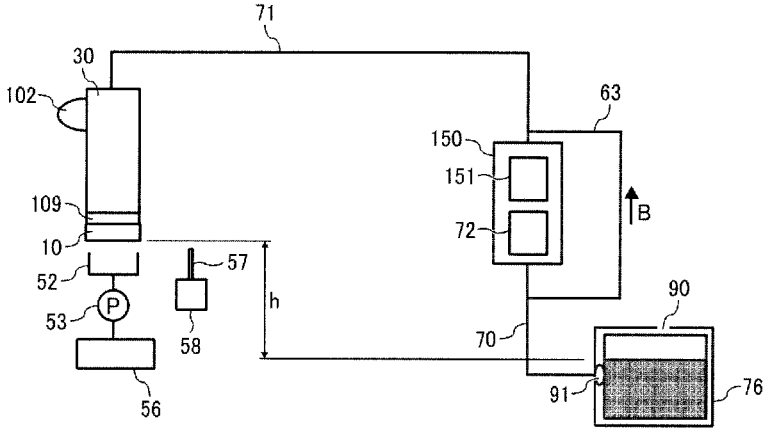
FIG. 13 is a schematic view of an ink supply system according to a third exemplary embodiment.
Figure 14:
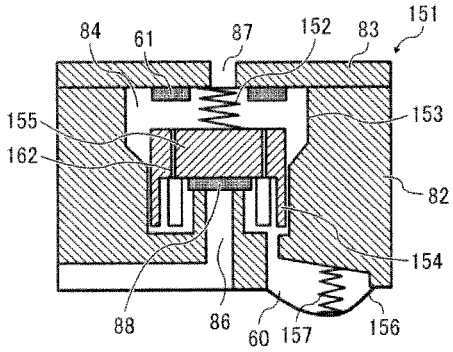
FIG. 14 is a cross-sectional view of a control valve used in the ink supply system illustrated in FIG. 14.
Figure 15:
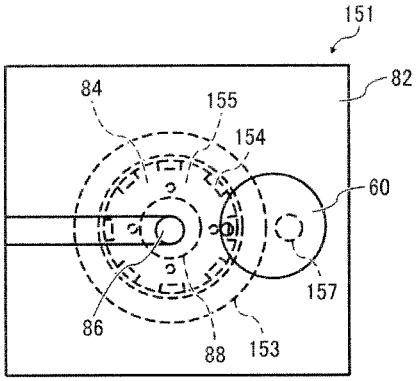
FIG. 15 is a plan view of the control valve of FIG. 14 seen from the bottom side.
Figure 16:
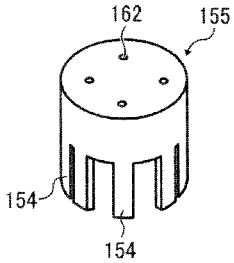
FIG. 16 is a perspective view of a valve member of the control valve illustrated in FIG. 14.

FIG. 13 is a schematic view of an ink supply system according to the third exemplary embodiment. FIG. 14 is a cross-sectional view of a control valve of the ink supply system illustrated in FIG. 13. FIG. 15 is a plan view of the control valve of FIG. 14 seen from the bottom side. FIG. 16 is a perspective view of a valve member of the control valve. In this exemplary embodiment, the ink supply system is described as a system for supplying one color ink. Alternatively, as in the above-described exemplary embodiment, the ink supply system may be a system for supplying multiple color inks.

As illustrated in FIG. 13, an ink cartridge 76 has an air communication port 90 and is disposed at a position so that the liquid level of the ink cartridge 76 (surface of ink in the ink cartridge 76) is lower than a nozzle face of a recording head 10. As a result, in a state in which all ink supply passages are filled with ink, the water head difference h between the recording head 10 and the liquid level of the ink cartridge 76 creates a negative pressure in the recording head 10. The ink cartridge 76 is connected to the second passage 70 via a joint 91.

In this exemplary embodiment, the ink supply system includes a bypass passage 63 serving as a third passage to bypass an assistive unit 150.

As illustrated in FIGS. 14 and 15, a control valve 151 of the assistive unit 150 has a case member 82. A flexible film 156 is welded on one face of the case member 82. The control valve 151 also includes an inflow port 86 and a buffer chamber 60. The buffer chamber 60 is formed by sealing a circular opening of the case member 82 with the flexible film 156, thus allowing efficient capacity change. A first compression spring 157 is disposed within the buffer chamber 60, thus facilitating restoration of the capacity of the buffer chamber 60 after ink discharge.

The control valve 151 includes a diameter extended portion 153 at a portion of the duct 84 proximal to an outflow port 87. The diameter extended portion 153 has a greater diameter (greater cross-sectional area in a direction perpendicular to a direction of ink flow) than a portion of the duct 84 proximal to the inflow port 86. As in the above-described second exemplary embodiment, a valve member 155 has through holes 162 and a seal member 88. In addition, as illustrated in FIG. 16, multiple sliding portions 154 are formed at the lower side (proximal to the inflow port 86) of the valve member 155 so that adjacent ones of the sliding portions 154 are separated away from each other with clearances. The multiple sliding portions 154 slidably contact a wall surface of the duct 84. The valve member 155 is urged toward the inflow port 86 with a second compression spring 152 to maintain a sealed state of the inflow port 86 with the seal member 88 even when pressure is applied to ink in the inflow port 86.

Next, supply operation of the ink supply system according to this exemplary embodiment is described with reference to FIGS. 17A to 17D.

Figure 17A:
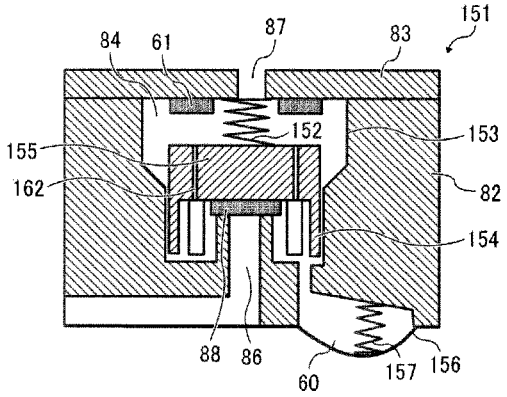
FIGS. 17A to 17D are cross-sectional views of the control valve during supply operation in the ink supply system of FIG. 13.

A pressure unit 72 in this exemplary embodiment has a configuration similar to the first exemplary embodiment and circulates ink with an assistive pump 73 to apply pressure to the inflow port 86 of the control valve 151. In this state, as illustrated in FIG. 17A, the duct 84 in the control valve 151 is shut from the inflow port 86 by the valve member 155 and the second compression spring 152. As a result, the outflow port 87 is maintained at a negative pressure as in the recording head 10.

Figure 17B:
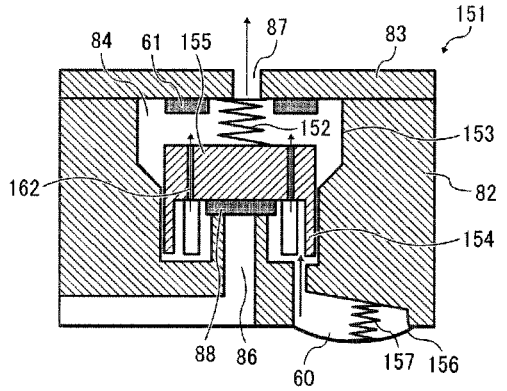
Figure 17C:
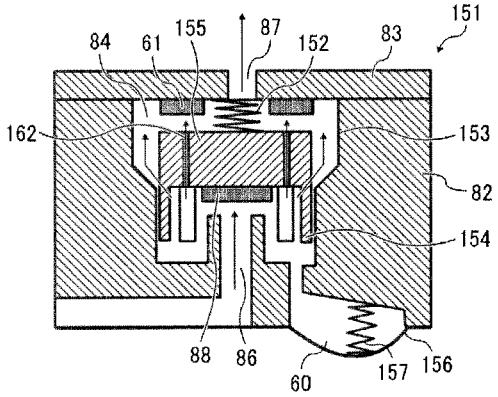

When ink is ejected from the recording head 10, ink is supplied from the head tank 30, thus increasing negative pressure within the head tank 30. As illustrated in FIG. 17B, such an increase in the negative pressure causes the buffer chamber 60 to contract, thus creating ink flow toward the outflow port 87 through the through holes 162 of the valve member 155. In a case in which the through holes 162 have a small diameter, the fluid resistance (resistance against ink flow) of the through holes 162 is large and the flow of ink passing through holes 162 creates a difference in pressure between upper and lower areas of the duct 84 than the valve member 155 (upstream and downstream areas of the duct 84 from the valve member 85 in a direction in which ink flows through the duct 84). As illustrated in FIG. 17C, the difference in pressure creates a force for raising the valve member 155 (moving the valve member 155 toward the outflow port 87), thus causing the valve member 155 to move up toward the outflow port 87. As a result, sealing of an intake 86*a* of the inflow port 86 with the valve member 155 is released, thus causing pressurized ink in the inflow port 86 to flow into the duct 84. Thus, ink is supplied to the outflow port 87 at high speed while inflating the buffer chamber 60.

As a result, ink is replenished into the head tank 30, thus reducing the negative pressure within the head tank 30 (to approximately zero). At this time, because ink passes through the through holes 162 of the valve member 155, the valve member 155 receives the force of ink flow to move up to an upper stop point. When the valve member 155 reaches the upper stop point, seal members 61 seal the through holes 162, thus stopping supply of ink from the control valve 151 to the head tank 30.

At this time, the pressure at the outflow port 87 becomes a positive pressure close to the pressure at the inflow port 86. Further, the ink flow through the through holes 162 serving as a drive source for raising the valve member 155 is lost, and a large difference in pressure created by the ink flow through the through holes 162 is also lost. As a result, the valve member 155 moves down by the force created by the second compression spring 152 to close the inflow port 86 as illustrated in FIG. 17A.

Figure 17D:
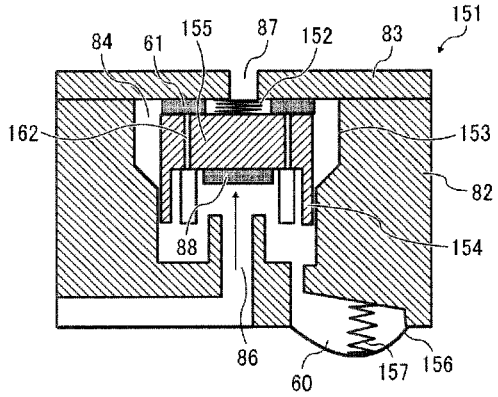

In this exemplary embodiment, as described above, the control valve 151 includes the diameter extended portion 153. Accordingly, when the valve member 155 approaches the upper stop point, as illustrated in FIG. 17D, the upper face of the valve member 155 reaches the diameter extended portion 153, and pressurized ink flows from the gaps between the sliding portions 154 to the diameter extended portion 153, thus causing ink to be supplied to the outflow port 87. Accordingly, ink flow through the through holes 62 are stopped, thus eliminating the difference in pressure between the upper and lower sides of the valve member 155. As a result, only the inertial force of the valve member 155 itself acts as the force for raising the valve member 155. In a case in which the inertial force is great, as described above, the valve member 155 continues to move up to reach the upper stop point. By contrast, in a case in which the inertial force is small, the valve member 155 does not reach the upper stop point and moves down because the inertial force is surpassed by the force of the second compression spring 152. As a result, as illustrated in FIG. 17A, the valve member 155 returns to a state in which the valve member 155 seals the inflow port 86.

In the control valve 151 according to this exemplary embodiment, when an upper portion of the valve member 155 reaches the diameter extended portion 153, the sliding portions 154 allows smooth movement of the valve member 155. In addition, the force of returning the valve member 155 to a lower stop point is created by the second compression spring 152, thus allowing optional setting of the moving direction of the valve member 155. In addition, as described above, the buffer chamber 60 includes the first compression spring 157, thus reliably restoration of the capacity of the buffer chamber 60.

As described above, in the control valve 151 according to this exemplary embodiment, ink ejection from the recording head 10 also causes ink flow from the buffer chamber 60 in the control valve 151, thus moving the valve member 155. As a result, a certain amount of pressurized ink is supplied toward the recording head 10 at high speed, and the valve member 155 closes. Accordingly, even in a case in which the ink to be ejected from the recording head 10 is highly viscous, the liquid supply tube 71 has a high resistance to fluid flow (the tube 71 is narrow or long), and/or the amount of ink ejection flow is large, the above-described configuration can properly supply ink while preventing delay in ink supply that is otherwise caused by the fluid resistance of the ink supply tube and maintaining the pressure in the recording head within a certain range.

Figure 18:
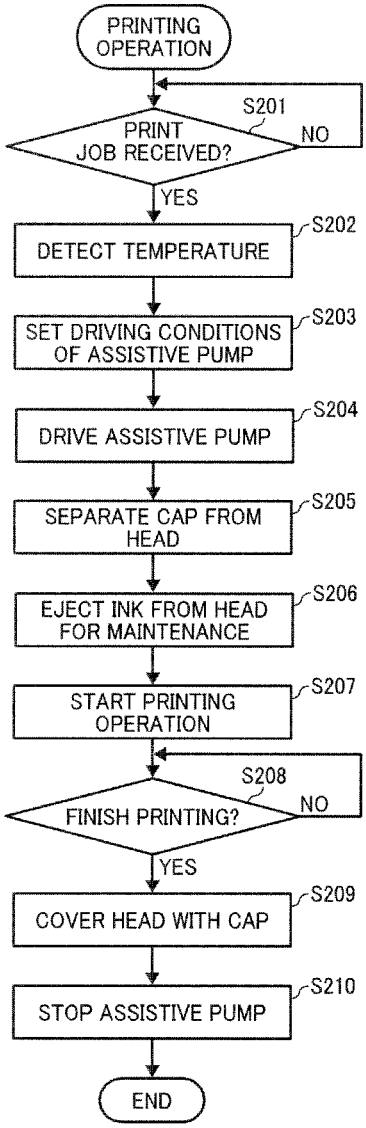
FIG. 18 is a flowchart showing a procedure of printing operation in the third exemplary embodiment.

Here, printing operation according to this exemplary embodiment is described with reference to FIG. 18.

When a print job signal is received (YES at S201), at S202 a temperature sensor 27 (see FIG. 2) detects temperature. When driving conditions of the assistive pumps 73 are set at 203, at S204 the motor 74 is driven to start liquid sending of the assistive pumps 73. At S205, the caps 52 covering the nozzle faces of the recording heads 10 are separated from the nozzle faces, and at S206 a predetermined count of droplets of ink is ejected for maintenance. At S207, printing operation is started.

When printing operation is terminated (YES at S208), the carriage 4 is stopped at a predetermined position (home position) of the apparatus. At S209, the caps 52 cover the nozzle faces of the recording heads 10. At S210, the motor 74 is stopped to terminate the liquid sending of the assistive pumps 73. Alternatively, the assistive pumps 73 may be stopped immediately after the termination of printing operation.

In the ink supply system according to this exemplary embodiment, the ink cartridges 76 and the recording heads 10 constantly communicate with each other via the bypass passages 63. Accordingly, in a case in which the viscosity of ink is low under high-temperature environment or other conditions, ink can be supplied through the bypass passage 63 without activating the assistive unit 150. In other words, by an amount of ink ejected from the recording head 10, ink flows through the bypass passage 63 in a direction indicated by an arrow B in FIG. 13 and is automatically replenished to the ink cartridge 76.

By contrast, in a case in which the viscosity of ink is high under low-temperature environment, the above-described shortage of ink replenished to the ink cartridge 76 might be caused by the fluid resistance of the ink supply passage. Hence, before recording, the assistive unit 150 is activated to supply ink by a shortfall of ink in a case in which ink is replenished only through the bypass passage 63. For such a configuration, even in a case in which the liquid supply tube 71 is long and a highly viscous ink is employed, pressure loss involved with ink supply can be properly minimized, thus allowing excellent printing without causing shortage of ink supply.

Next, a fourth exemplary embodiment of the present disclosure is described with reference to FIGS. 19, 20A, 20B, and 21.

Figure 19:
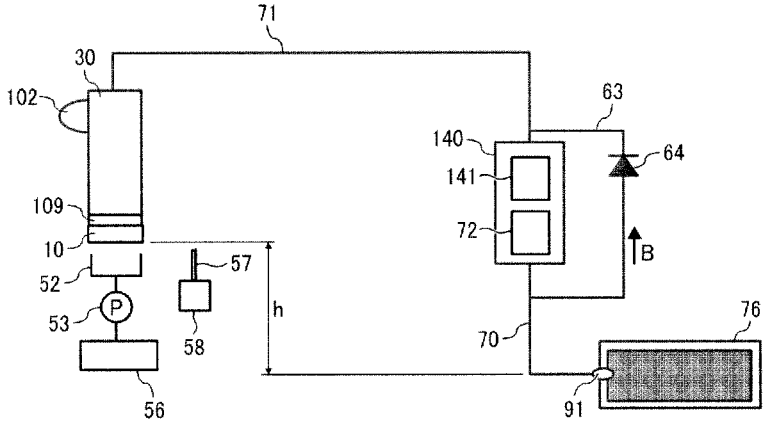
FIG. 19 is a schematic view of an ink supply system according to a fourth exemplary embodiment.
Figure 20A:
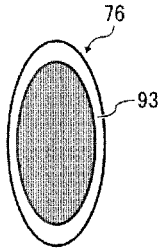
FIGS. 20A and 20B are cross-sectional views of an ink cartridge used in the ink supply system of FIG. 20.
Figure 20B:
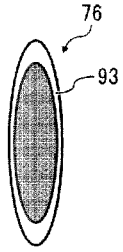
Figure 21:
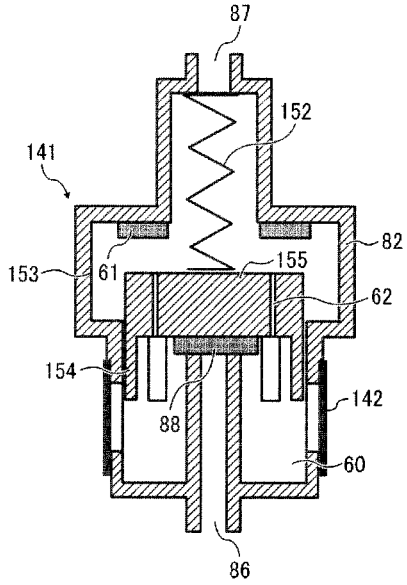
FIG. 21 is a cross-sectional view of a control valve used in the ink supply system of FIG. 20.

FIG. 19 is a schematic view of an ink supply system according to the fourth exemplary embodiment. FIGS. 20A and 20B are cross-sectional views of an ink cartridge of the ink supply system illustrated in FIG. 19. FIG. 21 is a cross-sectional view of a control valve of the ink supply system illustrated in FIG. 19. In this exemplary embodiment, the ink supply system is described as a system for supplying one color ink. Alternatively, as in the above-described exemplary embodiment, the ink supply system may be a system for supplying multiple color inks.

In the ink supply system according to this exemplary embodiment, a bypass passage 63 to bypass an assistive unit 140 is provided with a check valve 64 serving as a regulator to regulate ink flow in a direction opposite the direction indicated by an arrow B in FIG. 19. The bypass passage 63 with the check valve 64 allows ink pressurized at the assistive unit 140 to be efficiently sent to the head tank 30. In this exemplary embodiment, ink flow from the first passage (liquid supply tube 71) to the second passage 70 is regulated. Alternatively, ink flow toward the liquid tank may be regulated.

As illustrated in FIGS. 20A and 20B, the ink cartridge 76 stores liquid within a bag member 93 made of a flexible material capable of flexibly deforming in response to ink consumption (ink ejection) and is disposed lower than the nozzle face of the recording head 10. For such a cartridge configuration, the ink supply system is formed as a sealed system, thus facilitating stable maintenance of the quality of liquid to be supplied to the recording head. In addition, in the ink supply system, the pressure within the recording head 10 is maintained at a negative pressure by the level difference between the recording head 10 and the ink cartridge 76, thus stabilizing the negative pressure.

As illustrated in FIG. 21, a control valve 141 of the assistive unit 140 has a case member 82 and a tube-shaped elastic member 142 connected to the case member 82 to form a buffer chamber 60. Such an elastic member allows smooth restoration of the capacity of the buffer chamber 60 even without disposing a compression spring within the buffer chamber 60.

Next, a fifth exemplary embodiment of the present disclosure is described with reference to FIGS. 22, 23A, 23B, 24A, 24B, and 24C.

Figure 22:
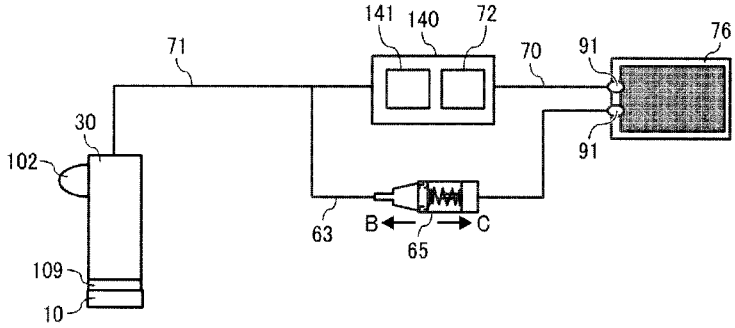
FIG. 22 is a schematic view of an ink supply system according to a fifth exemplary embodiment.
Figure 23A:
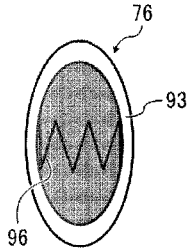
FIGS. 23A and 23B are cross-sectional views of an ink cartridge used in the ink supply system of FIG. 22.
Figure 23B:
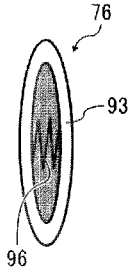
Figure 24A:
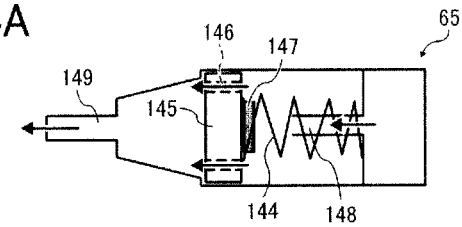
FIGS. 24A to 24C are cross-sectional views of a switching valve used in the ink supply system of FIG. 22.
Figure 24B:
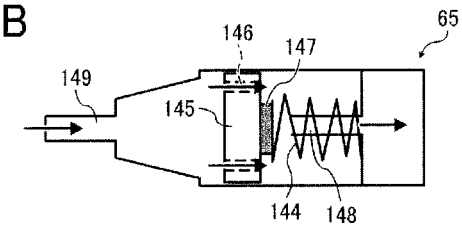
Figure 24C:
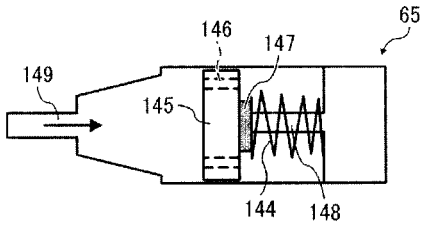

FIG. 22 is a schematic view of an ink supply system according to the fifth exemplary embodiment. FIGS. 23A and 23B are cross-sectional views of an ink cartridge of the ink supply system illustrated in FIG. 22. FIGS. 24A to 24C are cross-sectional views of a switching valve of the ink supply system illustrated in FIG. 22. In this exemplary embodiment, the ink supply system is described as a system for supplying one color ink. Alternatively, as in the above-described exemplary embodiment, the ink supply system may be a system for supplying multiple color inks.

In this exemplary embodiment, the ink cartridge 76 has a compression spring 96 within a bag member 93 made of a flexible material capable of flexibly deforming in response to ink consumption. For such a cartridge configuration, the ink cartridge 76 automatically creates a negative pressure. Accordingly, for example, as illustrated in FIG. 22, the ink cartridge 76 can be disposed at a position higher than the nozzle face of the recording head 10.

In the ink supply system according to this exemplary embodiment, the ink cartridge 76 is directly connected to the bypass passage 63 via a joint 91, and a switching valve 65 serving as a regulator to open and close in response to an amount of ink flowing in a direction indicated by an arrow C in FIG. 22.

As illustrated in FIGS. 24A to 24C, the switching valve 65 has two ink ports, i.e., a first port 148 and a second port 149. Specifically, the switching valve 65 has the first port 148 at a position proximal to the ink cartridge 76 and the second port 149 at a position proximal to the recording head 10.

The switching valve 65 has a valve member 145 within a channel between the first port 148 and the second port 149. The valve member 145 includes through holes 146 and is movably disposed within a case member of the switching valve 65. The valve member 145 is urged with a compression valve 144. When no ink flows in the switching valve 65 or ink flows from the first port 148 to the second port 149, as illustrated in FIG. 24A, the valve member 145 is positioned close to the second port 149. At this time, the first port 148 communicates with the second port 149 through the through holes 146.

By contrast, when ink flows in the opposite direction (the direction indicated by the arrow C in FIG. 22), ink passes through the through holes 146 of the valve member 145 toward the first port 148, thus creating a difference in pressure between upstream and downstream areas from the valve member 145 in the switching valve 65. As a result, the valve member 145 receives a force directed toward the first port 148 and moves toward the first port 148.

Here, in a case in which the amount of ink flow toward the first port 148 is small, the force acting on the valve member 145 is also small and balanced with the urging force of the compression spring 144. As a result, as illustrated in FIG. 24B, the valve member 145 stops at an intermediate position, thus maintaining the communicated state between the first port 148 and the second port 149.

By contrast, in a case in which a great amount of ink flows into the second port 149, the valve member 145 pushes the compression valve 144 to seal the first port 148 with a seal member 147.

By disposing the switching valve 65 at the bypass passage 63, in a case in which, in response to ejection of ink from the recording head 10, ink is slowly supplied from the ink cartridge 76 via the bypass passage 63, ink flows in the direction indicated by the arrow B in FIG. 22. As a result, the valve member 145 moves to the position proximal to the second port 149, thus causing the first port 148 to communicate with the second port 149 via the through holes 146 as illustrated in FIG. 24A. Alternatively, in a case in which an increase in the viscosity of ink increases the negative pressure within the head tank 30 and pressurized ink is intermittently supplied from the assistive unit 140 to the head tank 30, a great amount of ink may try to pass through the bypass passage 63 in the direction indicated by an arrow C in FIG. 22. Hence, in this exemplary embodiment, the switching valve 65 closes as described above, thus substantially preventing reverse flow of ink through the bypass passage 63 and allowing ink to be efficiently supplied to the head tank 30.

In particular, in a case in which ink is supplied through a tube in a serial-type image forming apparatus, the recording head 10 repeatedly moves back and forth relative to the sheet 20 for scanning. In a case in which the accelerated velocity in the reciprocal movement of the carriage 4 is great, ink may be gradually sent to the head tank 30 by only the main scanning of the carriage 4. In a case in which the ejection flow amount of the recording head 10 is great, the ink sent to the head tank 30 by the scanning of the carriage 4 is consumed, thus causing no failure. By contrast, in a case in which the ejection flow amount of the recording head 10 is small, the amount of ink sent by the main scanning of the carriage 4 exceeds the consumption amount of ink, and as a result, the pressure within the recording head 10 may shift to a positive pressure.

To cope with such a failure, it is effective to facilitate return of ink from the head tank 30 to the ink cartridge 76. Hence, in the ink supply system according to this exemplary embodiment, when the negative pressure of the head tank 30 increases and pressurized ink of the assistive unit 140 is sent to the head tank 30, the switching valve 65 closes to efficiently assist the replenishment of ink. In a case in which the ejection amount of ink from the recording head 10 is small and the pressure within the head tank 30 increases with the main scanning of the carriage 4, the switching valve 65 opens to facilitate return of ink from the head tank 30 to the ink cartridges 76. Accordingly, even in the serial-type image forming apparatus that can perform main scanning at high speed, the ink supply pressure can be stably maintained.

In the above description, the operation and effects of exemplary embodiments are described taking examples in which different color inks are supplied to multiple recording heads. However, it is to be noted that, in another exemplary embodiment, a single color ink may be supplied to multiple recording heads or inks of different compositions may be supplied to multiple recording heads. Moreover, the liquid supply system may be applied to a configuration in which different types of liquids are ejected from a single head having multiple nozzle rows. The image forming apparatus is not limited to an image forming apparatus that ejects "ink" in strict meaning, and may be a liquid ejection apparatus (included in the image forming apparatus in this disclosure) that ejects liquid other than strictly-defined "ink".

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having nozzles to eject liquid droplets;

a liquid tank detachably mounted to the image forming apparatus to store liquid to be supplied to the recording head;

a first passage connected to the recording head to supply the liquid to the recording head;

a second passage connected to the liquid tank;

a pressure unit disposed at the second passage to apply pressure to liquid in the second passage; and a control valve disposed between the first passage and the second passage to control supply of the liquid from the second passage to the first passage, the control valve including an outflow port communicated with the first passage, an inflow port communicated with the second passage, an internal channel to connect the first passage and the second passage, an expandable liquid retaining chamber connected to the internal channel to retain the liquid, and a valve member disposed in the internal channel to open and close the first passage and the second passage and movable by a flow of liquid from the liquid retaining chamber to the first passage created by ejection of liquid from the recording head to communicate the second passage with the first passage, wherein a capacity of the expandable liquid retaining chamber is reduced by ejection of the liquid droplets from the recording head, and wherein the valve member is disposed within the internal channel, with a clearance between the valve member and the internal channel, the valve member is configured to be reciprocally movable to close the outflow port and to close the inflow port, and movement of the valve member to a position at which the valve member does not close any of the outflow port and the inflow port creates a flow of the liquid from the inflow port to the outflow port via the clearance.

2. The image forming apparatus according to claim 1, further comprising a third passage connecting the first passage to one of the second passage and the liquid tank.

3. The image forming apparatus according to claim 2, further comprising a regulator disposed in the third passage to regulate a flow of liquid from the first passage to the one of the second passage and the liquid tank.

4. The image forming apparatus according to claim 3, wherein the regulator is a check valve to open and close in accordance with an amount of the liquid flowing from the first passage.

5. The image forming apparatus according to claim 1, further comprising a through-hole formed in the valve member to Communicate the first passage with the liquid retaining chamber.

6. The image forming apparatus according to claim 5, further comprising a seal member formed in the control valve to close the through-hole in contact with the valve member when the valve member is moved toward the first passage.

7. The image forming apparatus according to claim 1, wherein the liquid retaining chamber comprises a flexible member.

8. The image forming apparatus according to claim 7, further comprising an urging member disposed in the liquid retaining chamber to urge the flexible member in a direction to expand the liquid retaining chamber.

9. The image forming apparatus according to claim 8, wherein the urging member is a compression spring.

10. The image forming apparatus according to claim 1, wherein the liquid retaining chamber comprises an elastic member.

11. The image forming apparatus according to claim 1, further comprising a sliding portion formed on an outer circumferential portion of the valve member and slidable over an inner wall surface of the internal channel of the control valve.

12. The image forming apparatus according to claim 1, wherein movement of the valve member toward the first passage increases a width of flow of the liquid in the internal channel between the first passage and the liquid retaining chamber.

13. The image forming apparatus according to claim 1, further comprising a spring disposed in the control valve to urge the valve member toward the second passage.

14. The image forming apparatus according to claim 1, wherein the pressure unit generates pulsating pressure.

15. The image forming apparatus according to claim 1, wherein the inflow port and the outflow port are disposed at respective ends of the internal channel of the control valve, and the expandable liquid retaining chamber is disposed at a side of the internal channel that is more proximal to the inflow port than to the outflow port.

16. The image forming apparatus according to claim 1, wherein the clearance is formed between an outer circumference of the valve member and the internal channel.

17. The image forming apparatus according to claim 1, wherein the expandable liquid retaining chamber is communicated with the internal channel via one or more communication channels disposed in the valve member, and the communication channels have a diameter smaller than a diameter of each of the inflow port and the outflow port.

* * * * *